United States Patent [19]

Hudson

[11] 4,092,954

[45] June 6, 1978

[54] HIGH SPEED TANK DEVELOPMENT SYSTEM

[75] Inventor: Frederick W. Hudson, West Henrietta, N.Y.

[73] Assignee: Xerox Corporation, Stamford, Conn.

[21] Appl. No.: 802,156

[22] Filed: May 31, 1977

[51] Int. Cl.[2] ..... G03G 15/08

[52] U.S. Cl. ..... 118/658; 118/655

[58] Field of Search ..... 118/654, 657, 658, 656, 118/652, 662, 653, 647, 648, 649, 650, 651, 655

[56] References Cited

U.S. PATENT DOCUMENTS

| | | | |
|---|---|---|---|
| 3,617,123 | 11/1971 | Emerson | 118/652 X |
| 3,635,196 | 1/1972 | Tsilibes | 118/655 |
| 3,791,730 | 2/1974 | Sullivan, Jr. | 118/654 |
| 3,835,811 | 9/1974 | Eto | 118/654 |
| 3,870,017 | 3/1975 | Kratcoski et al. | 118/654 |
| 3,906,899 | 9/1975 | Harpavat | 118/655 |
| 3,920,329 | 11/1975 | Dennie et al. | 118/657 |
| 3,921,577 | 11/1975 | Howard et al. | 118/658 |
| 3,998,184 | 12/1976 | Hudson | 118/658 |
| 4,015,561 | 4/1977 | Howard et al. | 118/654 |

*Primary Examiner*—Louis K. Rimrodt
*Assistant Examiner*—Andrew M. Falik
*Attorney, Agent, or Firm*—James J. Ralabate; John E. Beck; George J. Cannon

[57] ABSTRACT

A development system for developing latent magnetic images with magnetic toner at high speeds comprises a developer housing comprising an upper toner supply chamber communicating through an opening with a sealed developer zone. The developer zone is defined by a lower wall member of the developer housing, a lip-seal attached to the developer housing at the entrance to the developer zone, the lip-seal being adapted to simultaneously reduce the turbulance of air flowing into the developer zone and to prevent toner from leaving the developer at the entrance thereto; a magnetic salvage assembly comprising magnetic field producing means, the magnetic salvage assembly being located above the developer zone, being adapted to remove airborne magnetic toner emerging from the developer zone and to direct said removed toner back into said toner supply chamber; and, intermediate said magnetic salvage assembly and said opening through which said toner supply chamber communicates with said developer zone, baffle means for redirecting a portion of airborne toner emerging from said developer zone into said toner supply chamber. Low friction resilient sealing means is provided on the developer housing along portions thereof engageable with a magnetizable imaging member bearing a latent magnetic image to be developed. The low friction sealing means is provided between said lip-seal at the entrance to the developer zone and said baffle means.

8 Claims, 5 Drawing Figures

HIGH SPEED TANK DEVELOPMENT SYSTEM

BACKGROUND OF THE INVENTION

This invention relates to magnetic imaging; and, more particularly, to development apparatus suitable for the high speed development of latent magnetic images with magnetic toner.

Latent magnetic images on magnetizable imaging members are typically developed by deposition of magnetic developer material commonly referred to as magnetic toner onto the magnetizable imaging member. The developing material is attracted to the magnetizable member by magnetic fields constituting the latent magnetic image.

However, in developing latent magnetic images on a magnetizable member, it is necessary to introduce the developing material within a very short distance from the latent magnetic image, typically within about 10 microns of the image, due to the short range nature of the magnetic forces associated with the latent magnetic image. Accordingly, flood contact development of latent magnetic images is generally preferred as a technique which will ensure that the magnetic toner material is introduced within the short distance from a latent magnetic image to allow full, dense development. Moreover, high speed development involving applying magnetic toner to a magnetic tape moving through its path of travel through the developer zone at a high rate of speed such as, for example, 100 inches per second or greater, invariably produces powder clouds of airborne toner. These powder clouds of airborne toner are quite troublesome, if not controlled, resulting in the probable redeposition of magnetic toner on areas of the developed image where magnetic toner is not desired and generally results in a dirty interior of the magnetic imaging device.

PRIOR ART STATEMENT

Flood contact development for xerographic development is shown in U.S. Pat. Nos. 3,685,488 (FIGS. 1, 2 and 3); U.S. Pat. No. 3,380,437 (FIGS. 1–3); 3,393,663 (FIGS. 2); 3,574,660 (FIGS. 1, 2 and 4); 3,641,977 (FIGS. 1–4) and in 3,682,137 (FIGS. 1 and 2). Descriptive portions of the aforementioned patents corresponding to the figures describe the xerographic developer behavior and operation of the apparatus. Flood contact development of latent magnetic images with magnetic toner is disclosed in U.S. Pat. No. 2,943,908 (FIG. 2). All of the aforementioned patents are deemed relevant only to the extent of showing flood, contact development of a latent image with toner material; except for aforementioned U.S. Pat. No. 3,685,488 (FIG. 2) illustrating a "Y" shaped relationship between toner hopper and toner development zone for continuous flow xerographic development.

Stationary magnets within rotating cylinders are disclosed in U.S. Pat. Nos. 3,900,001 and 3,906,121 as means for applying developer material to an imaging member to effect development thereof.

SUMMARY OF THE INVENTION

It is an object of this invention to provide a novel high speed tank development apparatus for applying magnetic toner to a magnetizable imaging member bearing a latent magnetic image in traveling at high speeds.

It is a further object of this invention to provide such developing apparatus which additionally minimizes the presence of powder clouds of airborne toner exterior to the development apparatus.

SUMMARY OF THE INVENTION

The aforementioned objects and advantages and others are realized in accordance with the practice of the present invention by a tank development system comprising an upper toner supply chamber communicating through an opening with a developer zone, said developer zone being defined by a lower wall member of said developer housing, a lip-seal at the entrance to the developer zone, said opening, resilient low friction developer zone side seals affixed to said lower wall portion; a magnetic salvage assembly located above said developer zone and adapted to remove airborne toner emerging therefrom and redirect same into said toner supply chamber; baffle means intermediate said developer zone and said magnetic salvage assembly for directing a portion of said airborne magnetic toner emerging from said developer zone into said toner supply chamber; and resilient low friction seals attached to the developer housing on the side thereof engageable with a developed magnetizable imaging member intermediate said developer zone and said baffle means.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

Figure 1:
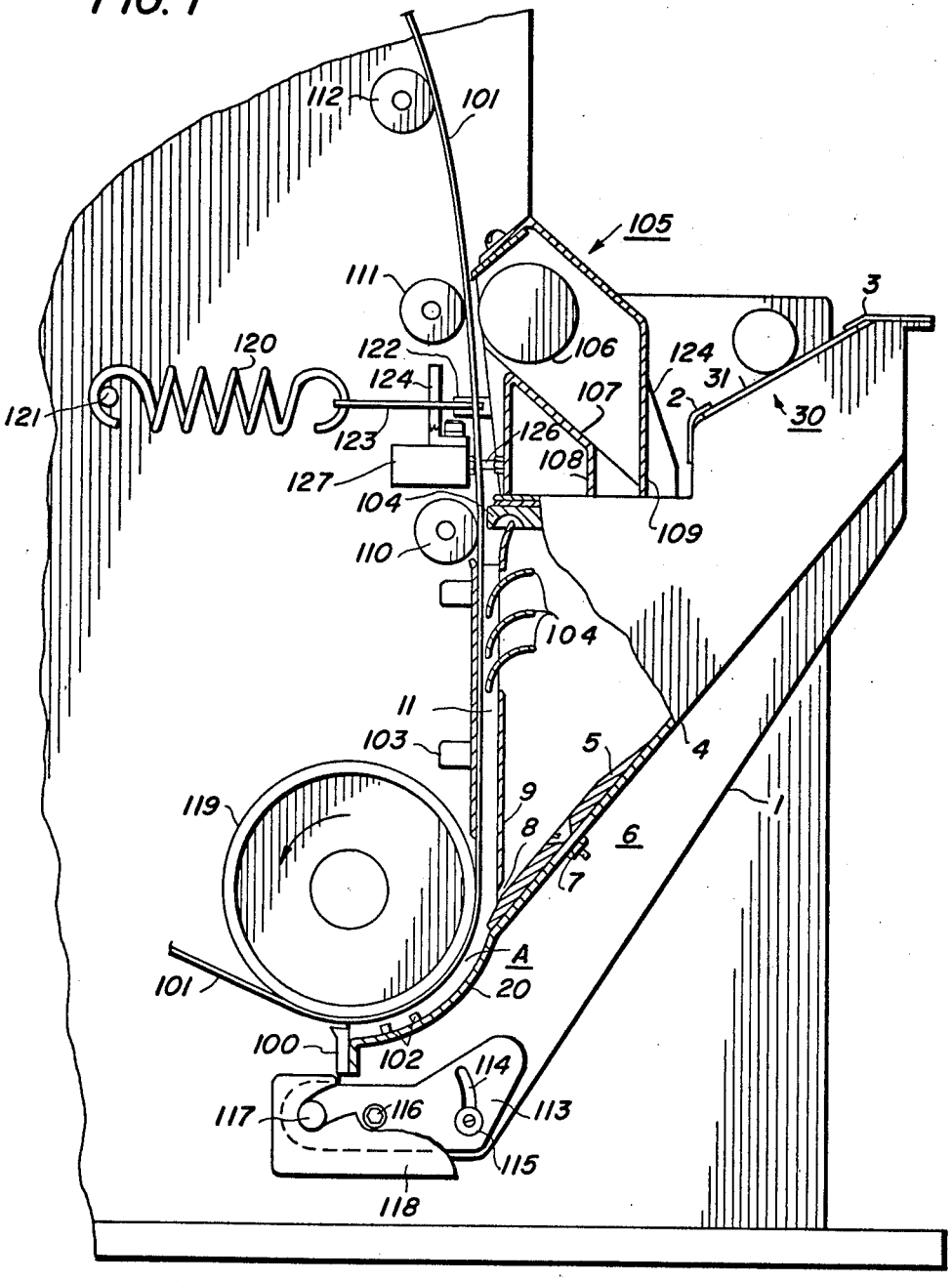
FIG. 1 is a schematic, cross-sectional side-view illustration of an embodiment of the present invention.

Referring now to FIG. 1, there is seen an embodiment of the present invention particularly preferred for development of latent magnetic images residing on magnetic webs or tape traveling through the developer zone at high speeds. The tank development apparatus of FIG. 1 comprises a housing 1 having an opening 30 in the uppermost wall covered by a sliding member 31 retained by flanges 2 and 3. Walls 9 and 4 of housing 1 define an upper toner storage or supply chamber communicating with a development zone A which extends from lip-seal 100 at the entrance to the developer zone and extending to the topmost portion of opening 8 or bottommost portion of wall 9. The upper supply chamber communicates with developer zone A through opening 8 and continuously replenishes the toner exhausted from development zone A upon toner being transferred from the developer zone to a latent magnetic image residing on magnetic tape 101.

Metering plate 5 is moveable into and out of opening 8 by movement of retention member 7 along slot 6 in wall 4. The developer housing is made of non-magnetic materials such as stainless steel to minimize interference with the latent magnetic image which is undergoing development and to minimize interference with the flowing properties of magnetic material deposited in the toner supply chamber. Adjustment of metering plate 5 allows the provisioning of magnetic toner from the upper supply chamber to the developer zone A at a rate which at least equals the rate of depletion of magnetic toner from the developer zone A in order to avoid excessive depletion of magnetic toner from the developer zone thereby maintaining adequate flood development contact between the magnetic toner and magnetic tape 101 throughout developer zone A.

Figure 4:
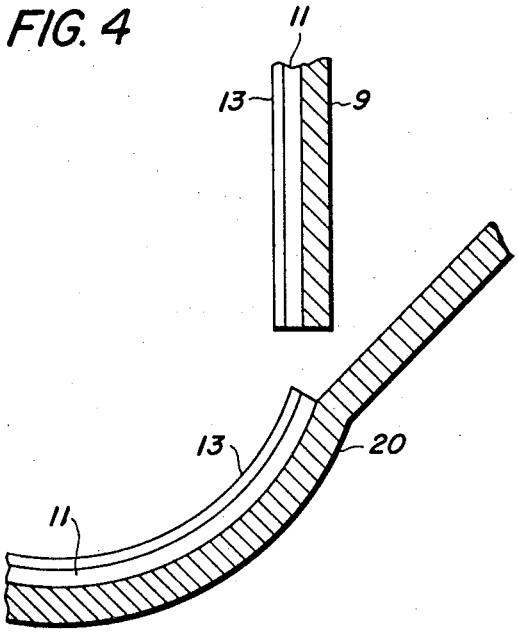
FIG. 4 is a schematic illustration of one embodiment of the resilient low friction side seals employed in the present invention.

Wall 20 of housing 1 is shaped to conform to a predetermined path of travel of magnetizable imaging member 101, illustrated in FIG. 1 as a magnetic tape but which can also be a magnetizable imaging surface of a drum. Wall 20 may comprise a portion of either wall 9, or wall 4, or may be a separate wall member of the developer housing. A type of resilient seal is a deformable seal forming means 11, illustrated in FIG. 4. Any suitable resilient or deformable material can be used. Typical suitable materials include thin Teflon, a trademark of DuPont for tetrafluoroethylene fluorocarbon resins; soft rubber and polyvinyl chloride foam. The resilient seal is affixed to walls 9 and 20 at least along the predetermined path of travel of the magnetizable imaging member which is to be developed. Resilient seal forming means 11 is affixed to walls 20 and 9 on the sides thereof opposite the toner supply chamber and engageable with the magnetizable imaging member. As illustrated in FIG. 4, a low friction material is applied to the surface of deformable seal forming means 11 as surface 13. Low friction layer 13 comprises a material which has a coefficient of friction less than that of the material of deformable seal forming means 11. Teflon provides an entirely satisfactory low friction surface 13 which can be adhered to or bonded to means 11. Low friction surface 13 is utilized to minimize damage to the magnetizable imaging member by decreasing the sliding friction. It will be appreciated that resilient means 11 and surface 13 can be one flexible seal member of tetrafluoroethylene fluorocarbon resins. Other resilient members such as molded plastics provided with low friction surfaces can be employed.

Figure 5:
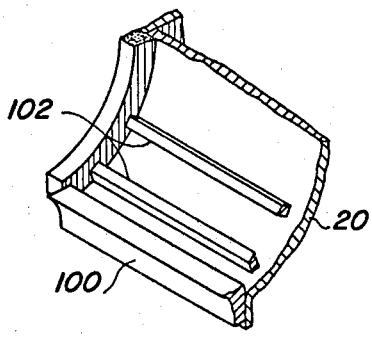
FIG. 5 is a schematic illustration of baffles employed in the development zone, showing their relationship to the lip-seal and the lower wall member of the developer housing which contributes to the definition of the developer zone.

Powder clouds of airborne toner are particularly troublesome in high speed magnetic imaging wherein speeds of 100 inches or more are encountered and due to the relatively light weight nature of magnetic developing material which comprises only toner, as contrasted with two component xerographic developers having a relatively heavy carrier as well as toner. The combination of high speeds and small, light weight magnetic toner particles typically produces powder clouds of airborne toner which cause contamination of the machine and a general increase in the amount of undesired toner residing on background areas of finished hard copy. Powder cloud contamination of the machine by air-borne toner is greatly minimized and virtually eliminated by the present invention. As shown in FIG. 1, lip-seal 100 is affixed to the developer housing at the entrance to developer zone A. Lip-seal 100 performs three functions: the first being to reduce air turbulance in developer zone A by parting the airstream accompanying magnetic tape 101 and diverting the separated air away from the developer zone A; the second function being to prevent magnetic toner from exiting the developer zone A through the entrance to the developer zone, and the third function being to increase the impedance to the air stream moving into the developer zone. Optional baffles 102, shown in FIG. 5, are preferably affixed to lower wall member 20 to counteract turbulance generated within developer zone A when magnetic tape 101 passes therethrough at high speed. Baffles 102 comprise simply rectangular metal members, preferably of non-magnetic material. Two such baffles 102 are shown, but any number can be employed in the developer zone.

As magnetic tape 101 emerges from developer zone A its path of travel is along backing plate 103 which provides rigidity to the seal formed between magnetic tape 101 and low friction resilient sealing means 11 during the portion of its path of travel between the exit of developer zone A and baffle means 104. Powder clouds of airborne toner are diverted, at least in part, from their normal course of flow in the direction of moving magnetic tape 101 into the upper supply chamber. The remaining portion of powder clouds of airborne toner continue to travel with magnetic tape 101 up to the magnetic salvage assembly 105. One embodiment of magnetic salvage assembly 105 (FIG. 2) comprises a rotating cylinder 106 rotating about stationary magnets (not illustrated in FIG. 1). The stationary magnets are arranged to provide a relatively strong magnetic field outwardly towards magnetic tape 101 in the area of the magnetic salvage assembly and either a relatively weak magnetic field or preferably no magnetic field on this side of the magnetic salvage assembly away from the magnetic tape 101. As the powder clouds of magnetic toner pass by the magnetic salvage assembly, magnetic toner is attracted by the magnetic fields onto the rotating cylinder 106 where they fall under the influence of gravity upon baffle 107 and are directed by the channel formed by wall members 108 and 109 back into the upper supply chamber.

In addition to the foregoing, as can be seen in FIG. 1, idler rolls 110, 111 and 112 rotatably guide magnetic tape 101 away from the development apparatus and along the remainder of its path of travel. The entire developer apparatus is pivotable towards and away from magnetic tape 101. The developer housing 1 has affixed thereto along its bottom portions a mounting bracket 113 containing slot 114 by way of retention members 115 and 116. Retention member 115 is loosened to allow the angular movement of developer housing 1 relative to mounting bracket 113. In turn, mounting bracket 113 carries post 117 which engages support bracket 118 as indicated in FIG. 1. By these means, the developer zone A can be adjusted to a uniform depth throughout its length and assures substantially uniform concentricity between lower wall member 20 and the surface of backing roll 119. The entire development apparatus is maintained in its adjusted, desired position by retention spring 120 anchored to pin 121 at its fixed end and to extension member 122 of housing 124 of the magnetic salvage assembly by way of spring extension rod 123 passing through rod guide 124. Adjustable post 126 mounted in stop block 127 maintains the desired positioning of the entire tank development apparatus.

Figure 2:
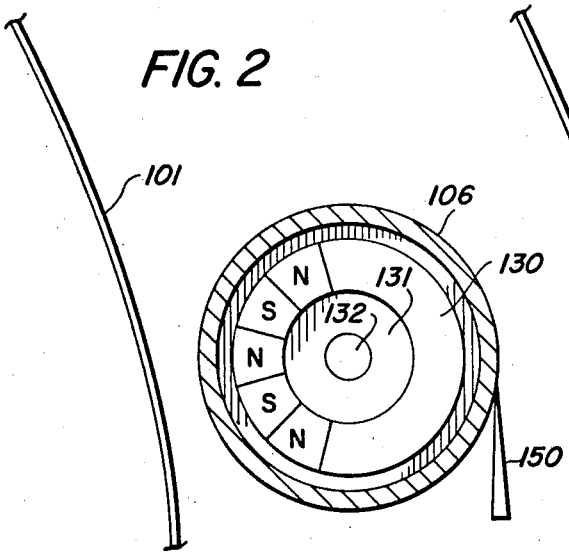
FIG. 2 is a schematic illustration of an embodiment of the magnetic salvage assembly.
Figure 3:
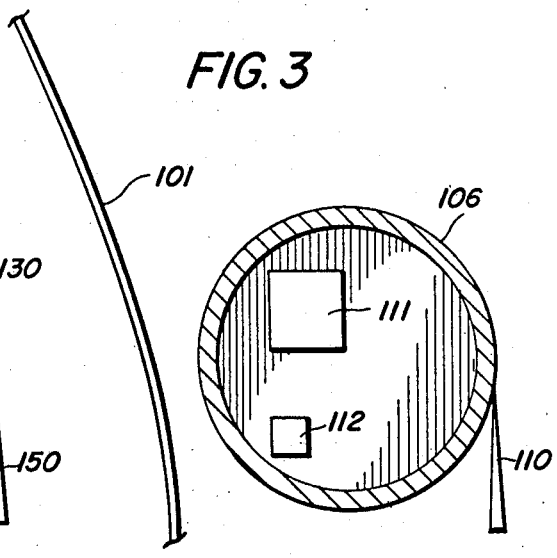
FIG. 3 is a schematic illustration of a second embodiment of the magnetic salvage assembly.

Referring now to FIG. 2 and FIG. 3, there are schematically illustrated alternate embodiments for the operative magnetic toner salvage portion of the magnetic salvage assembly 105. In FIG. 2, rotating cylinder 106 rotates past stationary magnetizable member 130 formed upon or mounted upon stationary core 131.

Support rod 132 is disposed longitudinally through support core 131 and supports magnetizable member 130 in its stationary position. These components in FIG. 2 can conveniently comprise those disclosed in U.S. Pat. No. 3,900,001 hereby expressly incorporated by reference. The magnetized portion of stationary magnetizable member 130 are depicted to as having alternating north and south poles on the side thereof facing magnetic tape 101, the side of magnetizable member 107 towards doctor blade 110 is not magnetized so that magnetic toner attracted from powder clouds of airborne magnetic toner to the surface of 106 are rotated away from the magnetic fields and can freely fall under the influence of gravity from cylinder 106 or easily dislodged therefrom by doctor blade 110. Doctor blade 110 is optional and its use depends upon the magnitude of the magnetic fields emanating from magnetized portions of magnetizable stationary member 130.

The alternate embodiment shown in FIG. 3 is one consisting of two rectangular permanent magnet bars 111 and 112 disposed within cylinder 106 towards the side thereof in the vicinity of magnetic tape 101. Permanent magnet 111 is sufficiently large to provide a magnetic field capable of attracting and retaining magnetic toner upon rotating cylinder 106 as cylinder 106 rotates between the 9:00 and 12:00 positions. Smaller magnet 112 is included to deflect magnetic toner towards the magnetic field of magnet 111 so that the magnetic toner can be captured by the latter field.

While the present invention has been described with respect to the preferred embodiments, it would be appreciated by those skilled in the art upon a reading of the present disclosure that other modifications and variations can be made thereto. These are intended to be within the spirit and scope of the present invention.

For example, there are other embodiments of the magnetic salvage assembly, such as a moving magnetic assembly, which can be utilized. The magnetizable member 130 can be provided throughout its periphery with alternating north and south magnetic poles and rotated to attract and maintain magnetic toner directly to member 130. Rotational cylinder 106 is dispersed with and a doctor blade used to scrape off magnetically held toner.

Further, it is preferable to pass the salvaged toner through a demagnetization field intermediate the magnetic salvage assembly and the toner supply chamber. An electro-magnet through which A.C. passes will supply such a field.

It will be appreciated that the magnetic salvage assembly must not provide a magnetic field at the magnetic imaging surface which is strong enough to erase the latent magnetic image or to remove the magnetic toner bound thereto in development. Thus, if the coercivity of the magnetizable material, Hc, is about 530 Oersteds (the value for chromium dioxide tape) the magnetic fields at the tape surface produced by the salvage assembly must be less than 530 Oersteds, probably no greater than about 400 Oersteds to provide a margin of safety.

What is claimed is:

1. Apparatus for applying magnetic toner to a latent magnetic image on an imaging member moving at high speed, comprising: a housing having an upper magnetic toner supply chamber provided with an opening through which magnetic toner can flow under the influence of gravity; a bottom housing wall member below said opening and shaped to conform to a portion of the path of travel of said imaging member; a lip-seal affixed to said bottom housing wall member adapted to divert air flow away from and retain magnetic toner upon, said bottom housing wall member; means for magnetically salvaging airborne magnetic toner located above said toner supply chamber and adapted to deposit salvaged toner into said toner supply chamber; baffle means, located intermediate said magnetic salvaging means and said opening; adapted to divert airborne toner from the vicinity of said imaging member into said upper toner supply chamber; and low friction, resilient sealing means for confining toner between said imaging member, said lip-seal and said developer housing.

2. The apparatus of claim 1 further including baffles affixed to said bottom housing wall member intermediate said lip-seal and said opening.

3. The apparatus of claim 1 wherein said means for magnetically attracting and retaining magnetic toner and located within said cylinder comprises a member bearing alternating magnetic polarities.

4. The apparatus of claim 1 wherein said means for magnetically attracting and retaining magnetic toner and located within said cylinder comprises permanent magnets.

5. The apparatus of claim 1 further including means for pivotally mounting said apparatus adjacent said portion of the path of travel of said imaging member.

6. The apparatus of claim 5 further including means for adjusting the angular disposition of said apparatus relative to said pivotal mounting means.

7. The apparatus of claim 6 further including means for retaining said apparatus in said adjusted disposition.

8. The apparatus of claim 1 wherein said magnetic salvaging means comprises a rotational cylinder within which is located means for magnetically attracting and retaining magnetic toner upon said cylinder during only a portion of its rotation.

* * * * *